US009248648B2

(12) United States Patent
Giusti et al.

(10) Patent No.: US 9,248,648 B2
(45) Date of Patent: Feb. 2, 2016

(54) MICROFLUIDIC DIE WITH MULTIPLE HEATERS IN A CHAMBER

(71) Applicant: STMicroelectronics S.r.l., Agrate Brianza (IT)

(72) Inventors: Domenico Giusti, Monza (IT); Daniele Prati, Catania (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 0 days.

(21) Appl. No.: 14/310,898

(22) Filed: Jun. 20, 2014

(65) Prior Publication Data

US 2015/0367641 A1 Dec. 24, 2015

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14088* (2013.01); *B41J 2/1601* (2013.01)

(58) Field of Classification Search

CPC ..... B41J 2/14056; B41J 2/14112; B41J 2202/11; B41J 2002/14491; B41J 2002/14459; B41J 2/1404

USPC ..... 347/44, 45, 47, 57–59, 62, 63, 65

See application file for complete search history.

(56) References Cited

U.S. PATENT DOCUMENTS 7,832,843 B2 * 11/2010 Oikawa et al. ..... 347/59

* cited by examiner

*Primary Examiner* — An Do

(74) *Attorney, Agent, or Firm* — Seed IP Law Group PLLC

(57) ABSTRACT

The present disclosure is directed to a microfluidic die that includes a first larger heater and a second smaller heater is a single chamber. The first heater is configured to form a primary bubble that ejects fluid from a nozzle associated with the chamber. The second heater is configured to form a secondary bubble to prevent blow back caused when the primary bubble bursts and ejects fluid from the nozzle. The first and second heater may be coupled to a single input trace and a single ground trace.

17 Claims, 17 Drawing Sheets

MICROFLUIDIC DIE WITH MULTIPLE HEATERS IN A CHAMBER

BACKGROUND

1. Technical Field

The present disclosure is directed to a microfluidic delivery system including a die having multiple heaters in a single chamber.

2. Description of the Related Art

Microfluidic die are utilized in printers for ejection of drops of ink onto paper. FIG. 1 is an enhanced view of a fluidic path from an inlet 7 into a chamber 17 and through a nozzle 11 of a microfluidic die 13 of a known type. The nozzle 11 is formed through a nozzle plate 15 that is positioned over the chamber 17. In this view, the nozzle plate 15 has been cut along a center line of the nozzle to show a cross-section of the nozzle 11. In particular, the nozzle 11 has a lower opening 19 with a first diameter 29 that is significantly larger than a second diameter 31 of an upper opening 21. Walls of the nozzle are sloped between the lower opening 19 and the upper opening 21.

FIG. 2A is a top down view showing relative sizes of elements of the microfluidic die of FIG. 1. FIG. 2B is a cross-section view along line 2B-2B of FIG. 2A. The die 13 includes a single heater 23 that is positioned below the chamber 17. The heater 23 may be square with sides that each has a first dimension 25. The chamber 17 is also square, with sides each having a second dimension 27. The nozzle 11 includes the lower opening 19, which is larger than area of the chamber 17. The nozzle 11 includes the much smaller upper opening 21, which has the second diameter 31.

The heater 23 is configured to heat ink in the chamber 17. As the heater 23 reaches a threshold temperature, a bubble is formed in the chamber 17. When the bubble explodes, ink is ejected out of the nozzle. As the bubble explodes, ink that is not ejected can be pushed back into the inlet. This can create inefficiencies the microfluidic die.

BRIEF SUMMARY

The present disclosure is directed to a thermal microfluidic die that includes multiple heaters formed below a chamber that is configured to eject fluid from a nozzle. In one embodiment, a microfluidic die includes a substrate, a first heater formed on the substrate, a second heater formed on the substrate, a first microfluidic chamber aligned with the first heater and the second heater, and a first nozzle aligned with the first chamber. Both the first heater and the second heater are formed below the first chamber. The first heater is larger than the second heater. The first heater is configured to form a bubble to eject fluid from the first chamber. The second heater is configured to prevent blowback into a channel region that provides the fluid.

The die includes an inlet path through the substrate. The channel region is in fluid communication with the inlet path, the first microfluidic chamber, and the first nozzle. The die includes a third heater formed on the substrate, a fourth heater formed on the substrate, a second microfluidic chamber aligned with the third heater and the fourth heater, and a second nozzle aligned with the second chamber. The second nozzle being in fluid communication with the inlet path, the channel region, and the second chamber.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale.

DETAILED DESCRIPTION

Figure 1:
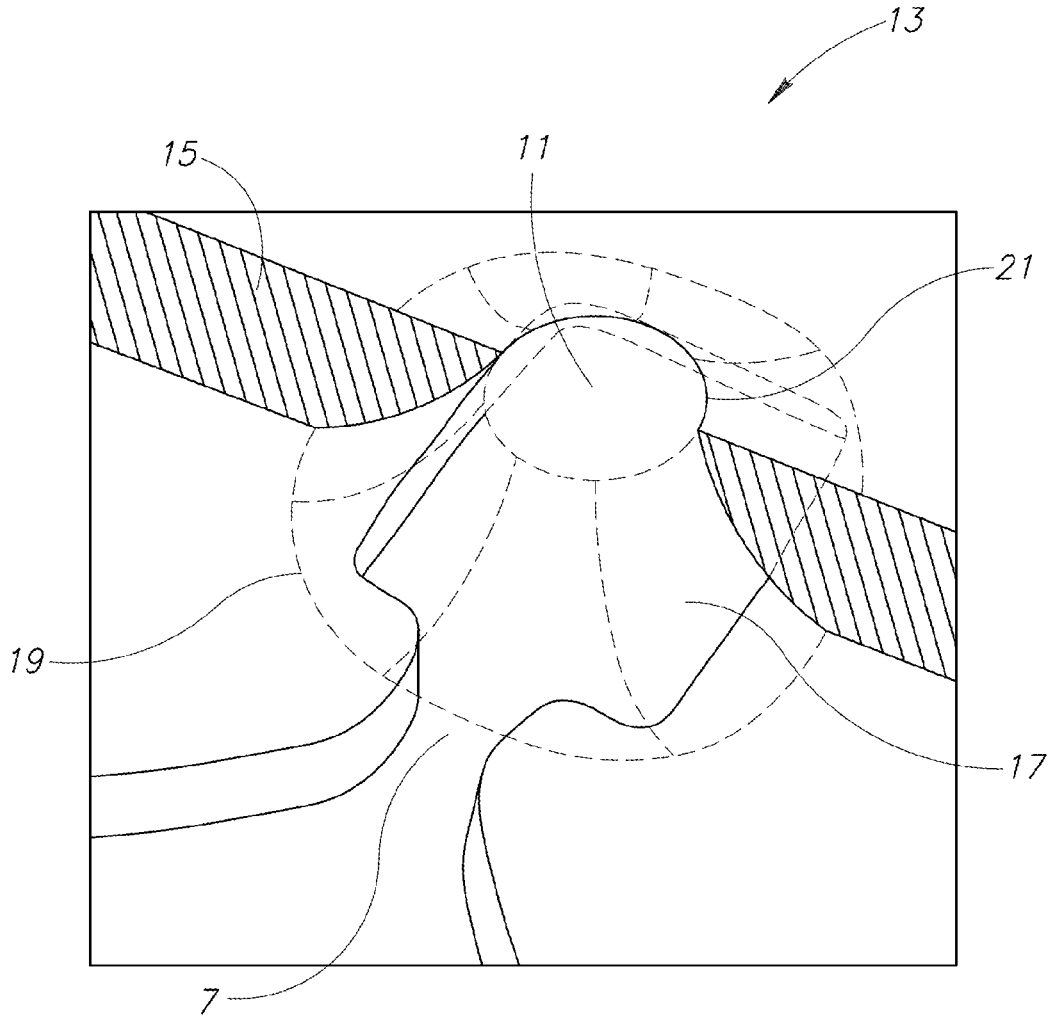
FIG.1 (PRIOR ART)
FIG. 1 is an enhanced view of a nozzle of a microfluidic die of a known type.
Figure 2A:
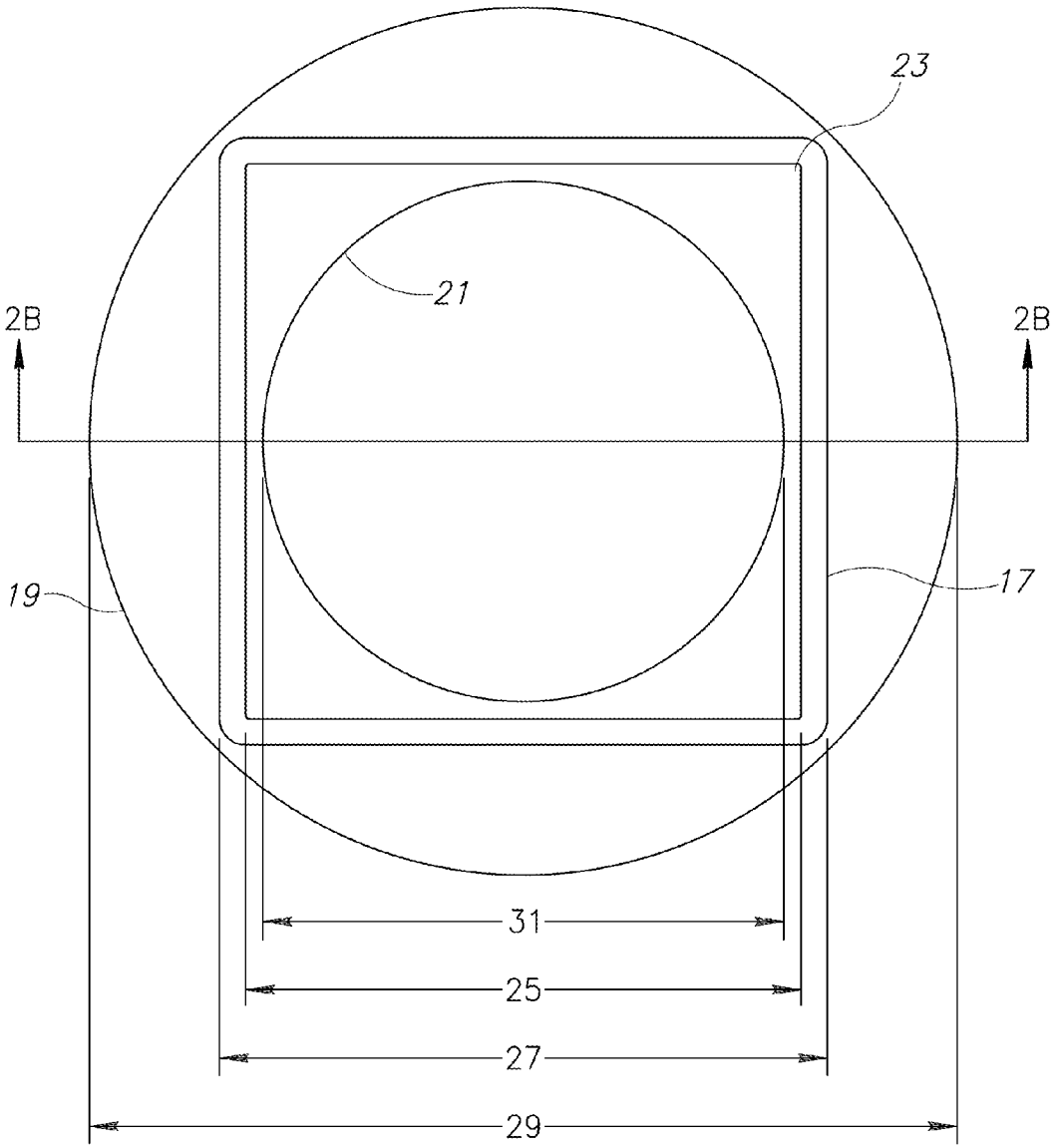
FIG.2A (PRIOR ART)
FIG. 2A is a top down view showing relative sizes of elements of the microfluidic die of FIG. 1.
Figure 2B:
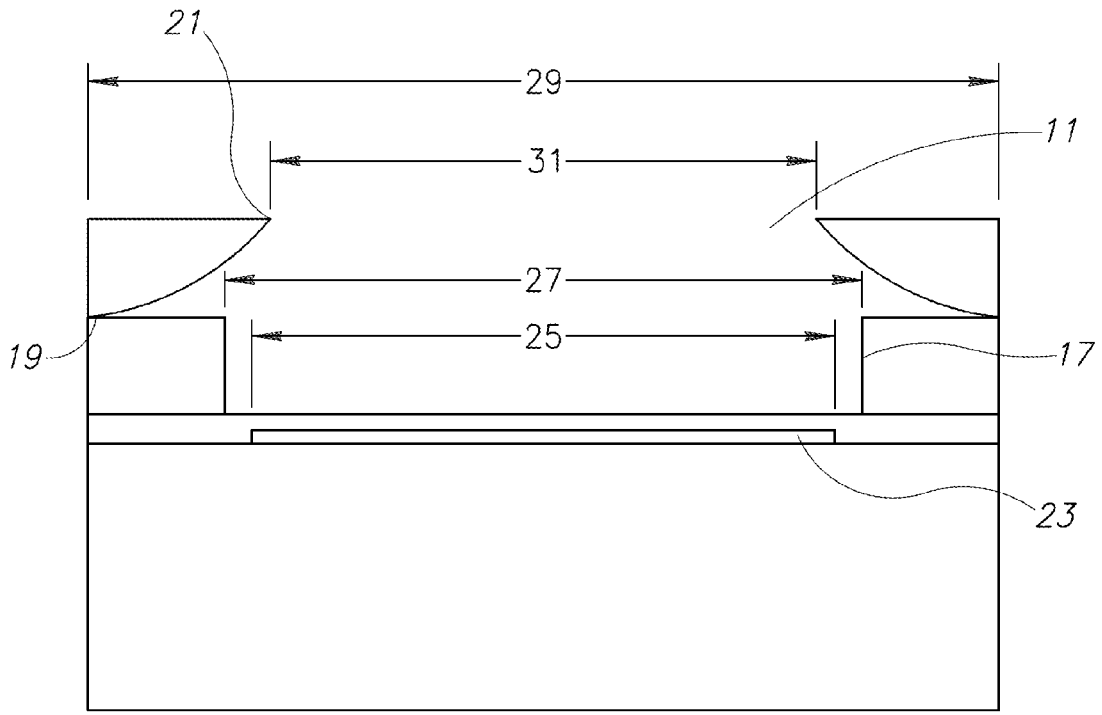
FIG.2B (PRIOR ART)
FIG. 2B is a cross-section view along line 2B-2B of FIG. 2A.

In the following description, certain specific details are set forth in order to provide a thorough understanding of various embodiments of the disclosure. However, one skilled in the art will understand that the disclosure may be practiced without these specific details. In other instances, well-known structures associated with electronic components and semiconductor fabrication have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As used in the specification and appended claims, the use of "correspond," "corresponds," and "corresponding" is intended to describe a ratio of or a similarity between referenced objects. The use of "correspond" or one of its forms should not be construed to mean the exact shape or size.

In the drawings, identical reference numbers identify similar elements or acts. The size and relative positions of elements in the drawings are not necessarily drawn to scale.

Figure 3:
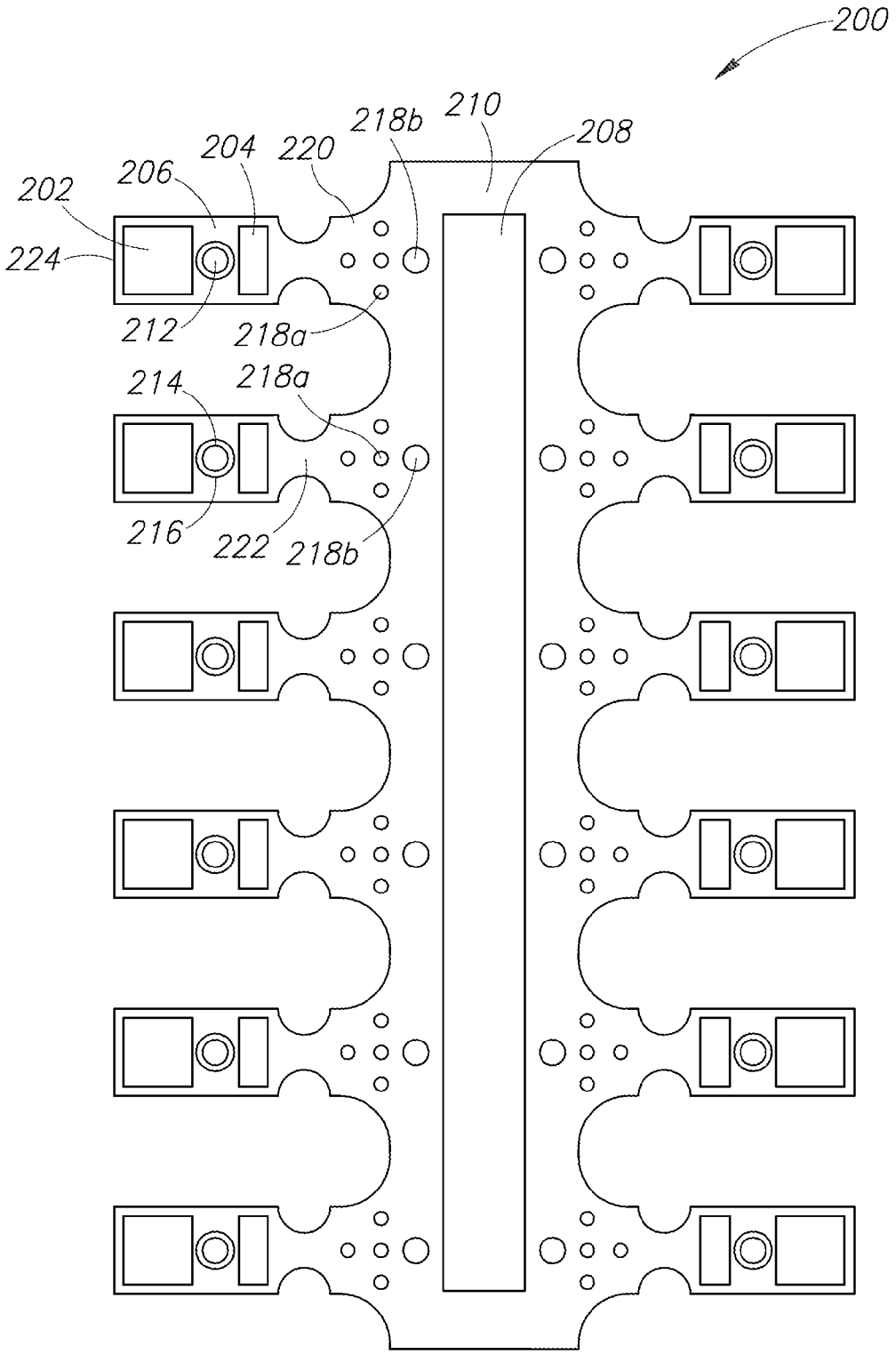
FIG. 3 is a top down view of an embodiment of a microfluidic die having multiple heaters in a chamber according to an embodiment of the present disclosure.

FIG. 3 is a top down view of a microfluidic die 200 having a plurality of chambers 206 that each includes multiple heaters, a first heater 202 and a second heater 204 according to an embodiment of the present disclosure. The die includes an inlet path 208 that moves fluid from an external reservoir into a channel 210 that feeds each of the chambers 206 with a fluid, such as ink or scented oil. The first heater in each chamber is configured to heat and eject the fluid from the chamber 206 through a nozzle 212. The first heater heats the fluid until a bubble is created. When the bubble bursts, fluid is ejected out of the nozzle. The force from the bursting bubble causes blowback that pushes fluid away from the chamber back into the channel 210. The second heater is configured to prevent the blowback by creating a smaller bubble.

In conjunction with the bubble created by the second heater 204, the die 200 includes a neck 222, which is a mechanical narrowing of a fluid flow path 220 from the inlet path 208 out through the nozzle 212. In this embodiment, each nozzle 212 is illustrated as having two concentric circles, a first inner circle 214 and a second outer circle 216. The outer circle 216 represents an entrance of the nozzle that is positioned closer to the heaters than an exit of the nozzle. The exit is represented by the first inner circle 214. In other embodiments, the nozzle may have an entrance and an exit that are the same dimension.

In this embodiment, the first heater 202 is larger than the second heater 204. In particular, the first heater 202 is a square with sides of a first dimension. The second heater 204 is rectangular having a length that is the first dimension and a width that is smaller than the first dimension. An area of the first heater may be twice as big as an area of the second heater. For example, the first dimension may be in the range of 51 microns and 71 microns. The second dimension may be in the range of 20 microns and 30 microns.

The first heater 202 is separated from the second heater 204 by the nozzle 212. In other embodiments, the nozzle may be directly over the first heater 202 or in other positions with respect to the heaters.

The die 200 includes the fluid flow path 220 between the inlet path 208 and each chamber 206. The fluid flow path 220 includes curved sidewalls. The neck 222 is positioned between the fluid flow path 220 and the second heater 204. The die 200 also includes a plurality of columns 218*a*, 218*b* positioned in the fluid flow path 220 and the channel 210 between the chamber 206 and the inlet path 208. These columns 218 are positioned to filter any large particles from the fluid as it moves through the inlet path. This prevents the nozzles or chambers from being blocked, which can shorten the life span of the microfluidic device. The columns may be circular as illustrated or may be any suitable shape. In this embodiment, there are larger columns 218*b* positioned closer to the inlet path and smaller columns 218*a* positioned closer to the chamber 206. The arrangement of the columns and number of smaller versus larger columns may be varied to suit the type of fluid and type of ejection selected for the final device.

The first heater 202 is positioned near an end 224 of the chamber 206 such that the second heater 204 is positioned closer to the neck 222. The first heater 202 is configured to be heated to form a bubble to eject fluid from the chamber 206 through the nozzle 212. The second heater 204 is configured to be heated harmoniously with the first heater 202 to inhibit excessive blowback of the fluid into the neck 222 and fluid flow path 220 when the bubble from the first heater 202 ejects fluid.

In particular, the first heater 202 is configured to heat a very small amount of fluid that is contained in the chamber. This die 200 is configured to eject any number of fluids selected by a user. For example, the fluid could be ink in an inkjet printer system, scented oil in an air freshener system, a medication, or any other type of fluid. The microfluidic die 200 can eject ink in a downward manner, in a vertical manner, or at an angled manner.

The first heater is heated and causes the fluid to boil, which generates a bubble. As the bubble collapses and explodes, the fluid is ejected from the nozzle 212. In order to achieve a variety of ejection techniques for a variety of fluids, the shape of the nozzle with respect to the area of the first heater can be selected to increase the ejection velocity. For example, higher heater to nozzle ratios allow the system to eject a plume of scented oils vertically. In prior art thermal inkjet systems one end of the nozzle is wider than the heater. These previous techniques did not allow for vertical ejection or ejection of different types of fluids, or compounds unknown by the manufacturer.

A temporary vacuum caused by the bubble collapse and capillary forces from the flow channel draw the fluid into the chamber. Blowback occurs when the bubble collapses and explodes causes fluid to flow away from the first heater 202 towards the channel 210 and towards the inlet path 208. The greater the blowback the longer it takes to refill the chamber 206 after the bubble explodes and some of the fluid leaves the nozzle. This blowback or reflux creates inefficiencies in the fluid flow. In some systems, it is beneficial to eject fluid very quickly, i.e. form many bubbles in rapid succession. For example, ejecting scented oils vertically can benefit from multiple ejections in rapid succession to form a vertical plume that carries the scented oil up and away from the die.

The second heater 204 is heated to prevent or minimize the effects of the blowback from the first heater 202. In conjunction with the narrower neck 222, the second heater 204 helps prevent fluid flow away from the nozzle and out of the chamber. The narrow neck 222 provides a physical limiter to the back flow of the fluid. In addition, the second heater 204 is provided to create another bubble that is configured to burst simultaneously with the bubble formed by the first heater. Alternatively, the second bubble has an alternative timing with respect to the bubble from the first heater. The timing is selected to have a second bubble formed by the second heater to inhibit fluid flow caused by the bursting of the first bubble formed by the first heater.

More particularly, the second heater 204 is provided to block or prevent back flow of the fluid from the bubble formed by the first heater 202. As noted above, the first heater 202 is larger than the second heater 204. The first heater is configured to form a first bubble that expels fluid from the nozzle. The second heater is configured to repeatedly form a second bubble barrier. In this way, the fluid sees no resistance when filling the chamber, but sees the force of the bubble from the second heater when the fluid is expelled from the nozzle. When filling the chamber, the second heater 204 will receive no power, i.e. no resistance and thus no heat will be generated.

This can increase the speed of refilling the chamber.

In one embodiment, the first heater and the second heater receive power at the same time or are otherwise driven simultaneously. The first heater causes formation of a primary bubble to expel fluid from the chamber. The second heater causes forming of one or more secondary bubbles that are smaller than the primary bubble. The secondary bubbles prevent backflow of liquid during a phase of explosion and collapse of the primary bubble. The second heater is positioned between the primary bubble location area and the neck 222. It is preferable for the secondary bubbles to be in their strongest position when the primary bubble is exploding. Accordingly, depending on the type of fluid or the frequency of bubble formation selected, it may be beneficial to have the smaller heater create multiple smaller bubbles in succession.

This arrangement with two heaters reduces reflux, increases efficiency, print quality, and increases the speed of subsequent filling of the chamber. This allows for more rapid phase of explosion of bubbles.

In some embodiments, both the first and second heater are formed from a same resistive material layer on a same level, i.e. the resistive material would be formed on a first dielectric level and then subsequently covered by a second dielectric level. In other embodiments, the first heater may be formed on a different dielectric level from the second heater. Alternatively, the first and second heater may be formed on the same layer of different materials having different resistances.

The second heater is a thermally activated fluid restriction feature for a bubble jet chamber. This could be used with standard ink used in ink jet printers. Alternatively, this could be used with alternative fluid systems, such as scented oils.

Figure 4:
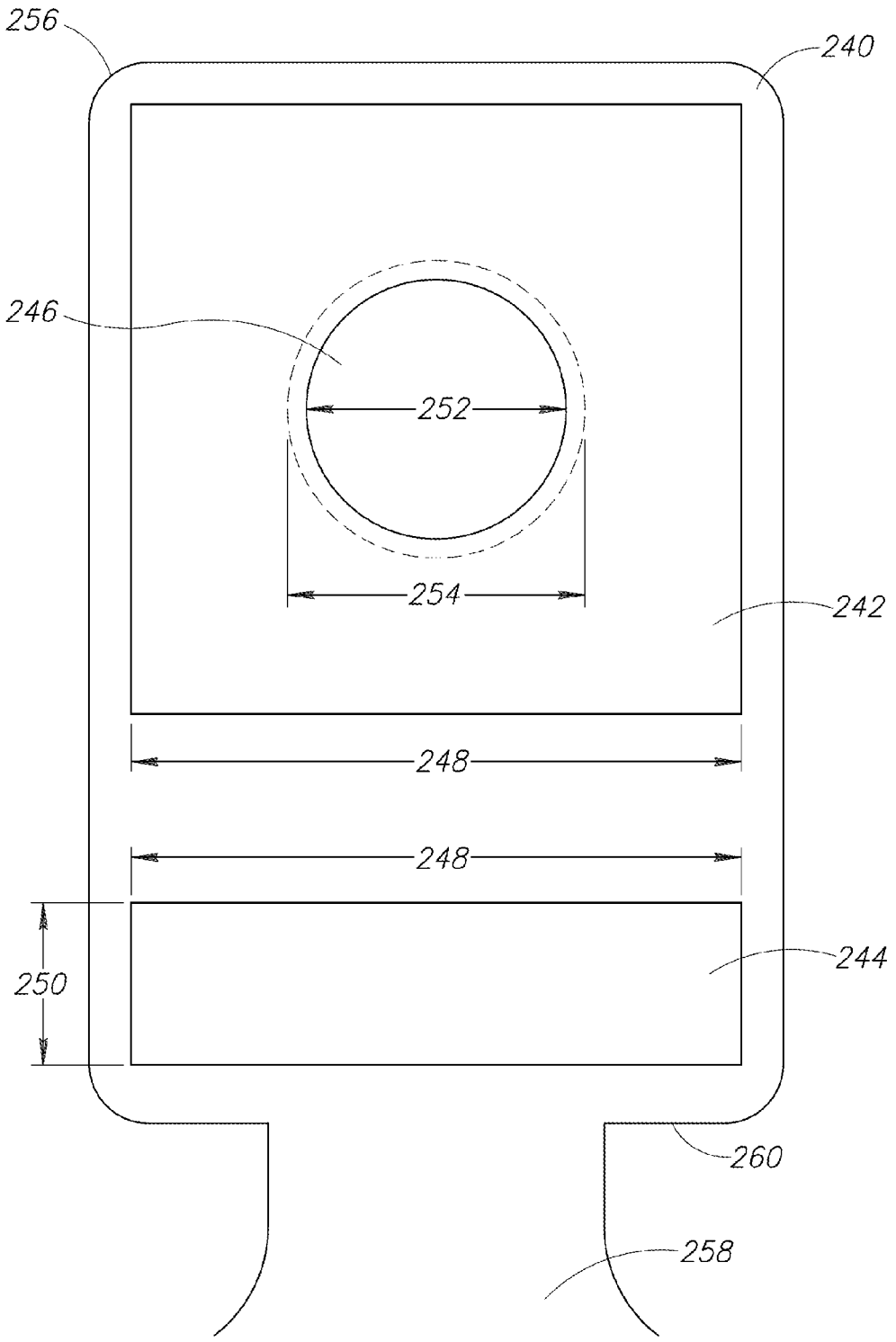
FIG. 4 is a top down view of an arrangement of multiple heaters in a chamber with a nozzle according to another embodiment of the present disclosure.

FIG. 4 is a top down view of an arrangement of multiple heaters 242, 244 in a chamber 240 with a nozzle 246 according to another embodiment of the present disclosure. In this embodiment, a first heater 242 is square with sides of a first dimension 248. A second heater 244 is rectangular with a length that is the first dimension 248. The second heater 244 is smaller in area than the first heater 242. The second heater 244 has a width that is a second dimension 250. The first dimension may be 45-50 microns. The second dimension may be 15-17 microns.

In this embodiment, the nozzle 246 is centrally positioned above the first heater 242. The nozzle 246 includes an exit diameter 252 and an entrance diameter 254. The entrance diameter 254 is positioned closer to the first heater than the exit diameter 252. The entrance diameter 254 is larger than the exit diameter 252, providing for steeply curved interior sidewalls of the nozzle 246. The exit diameter may be 20 microns while the entrance diameter may be 23 to 25 microns.

The nozzle shape can increase the pressure in the chamber, which allows for ejection of a variety of fluids. A high ratio of the first heater area to an exit nozzle area is particularly beneficial to ejection of oils mixed with ethanol or some other volatile fluid. This arrangement can eject drops of the oil, ethanol mixture upward in a manner that allows the ethanol to vaporize and allows the oil to move through the air. The fluid may be 90% oil and 10% ethanol. Using oil as the fluid to eject utilizes more heat because of the low vapor pressure of the oil in the chambers. Prior art systems are not able to eject oil effectively and may not even be able to form a bubble because of the low vapor pressure. By increasing a size of the heater and utilizing small nozzle exits, the present disclosure provides a successful ejection and consistent bubble formation in oil.

The chamber 240 is also generally rectangular with curved corners 256. In other embodiments, the corners 256 may be substantially right angles. The chamber 240 receives fluid from a fluid flow path 258. The fluid flow path 258 narrows as it approaches an end 260 of the chamber 240.

Figure 6:
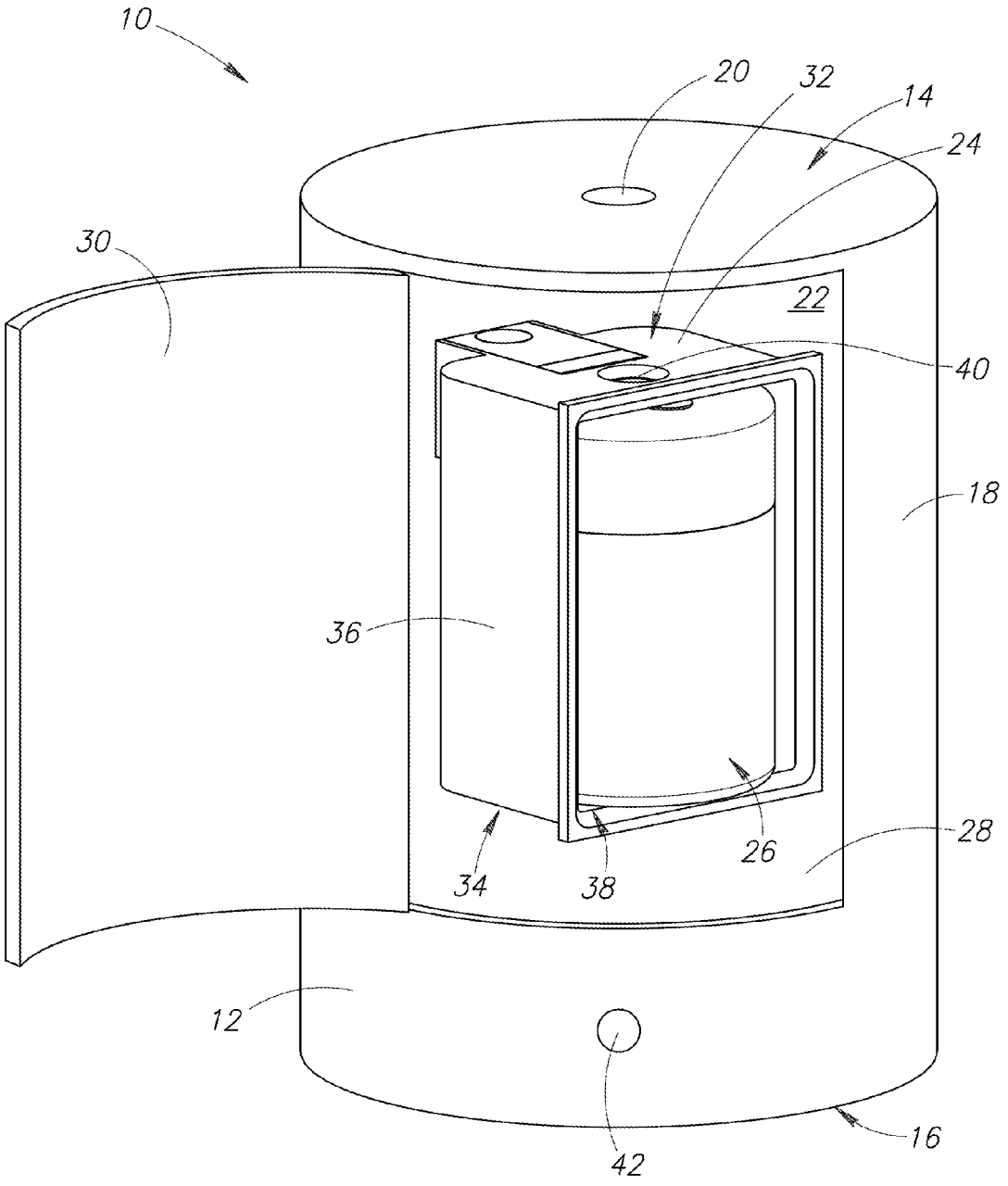
FIG. 6 is a schematic isometric view of a microfluidic delivery system in accordance with one embodiment of the present disclosure.

These microfluidic die may be utilized in a thermal inkjet printing system that ejects ink downward and includes active circuitry in the same die as the heating system, or the heating system may be included in a vertically ejecting system, such as the system described with respect to FIG. 6.

Figure 5A:
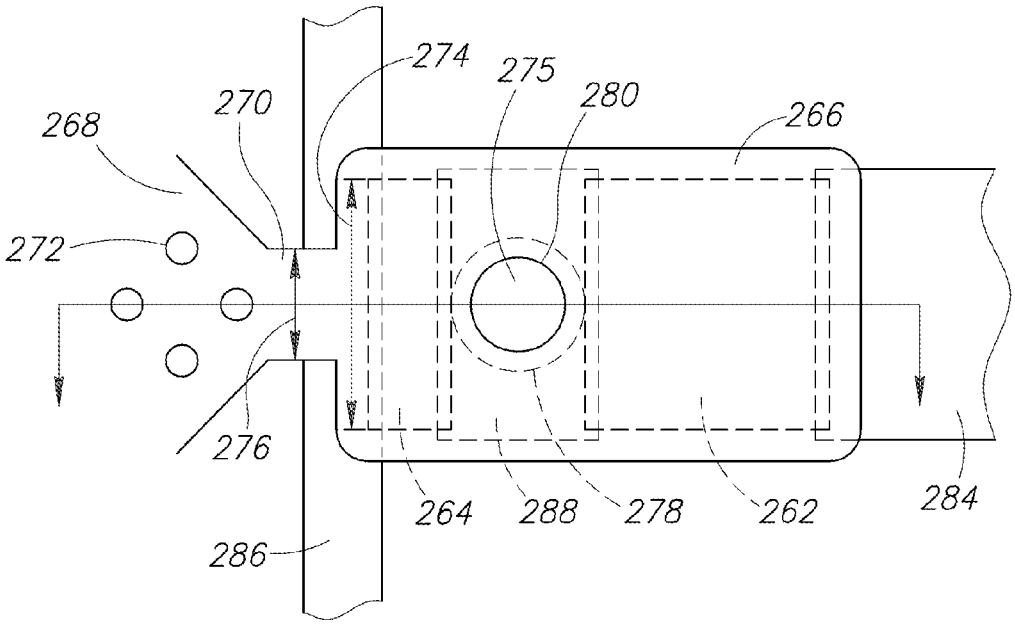
FIGS. 5A and 5B are a top down and cross-section views of an embodiment of multiple heaters of the present disclosure.
Figure 5B:
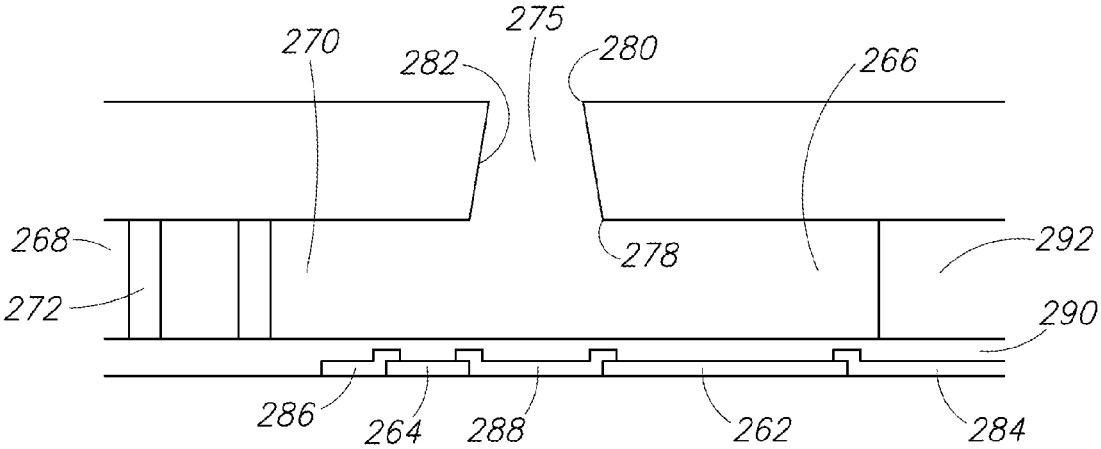

FIGS. 5A and 5B are a top down and cross-section views of an embodiment of multiple heaters 262, 264 in a chamber 266 in accordance with the present disclosure. The chamber 266 receives fluid from a fluid flow path 268 through a neck portion 270. A plurality of columns 272 are in the fluid flow path 268.

A first heater 262 is positioned further from the neck portion 270 than a second heater 264. In other words, the second heater 264 is between the neck portion 270 and the first heater 262. A nozzle 275 is positioned between the first heater 262 and the second heater 264. The nozzle 275 has a first diameter 278 that is positioned adjacent to the chamber 266 and can be considered an entrance of the nozzle. The nozzle 275 includes a second diameter 280 that is positioned further from the chamber than the first diameter. The different diameters cause the nozzle to have sloped or tapered sidewalls 282.

The nozzle 275 is between the first heater and the second heater. However, as mentioned above, the nozzle 275 may be positioned directly above the first heater 262.

An input trace 284 is coupled to the first heater 262 and an output trace 286 is coupled to the second heater 264. The input trace 284 runs substantially perpendicular to the output trace 286. An intermediate portion 288 is positioned between the first heater 262 and the second heater 264 to couple them together electrically. In this arrangement, the first heater and the second heater are driven at the same time. Due to the size of the heaters, they may form bubbles at different times or have explosions with different forces.

As will be described further below, the first and second heaters may be driven differently and may be coupled to separate input traces. The input traces are a conductive material that may be metal, such as aluminum or any other suitable conductor. The heaters may be tantalum silicon nitride.

In FIG. 5B, the output trace 286 overlaps the second heater 264 thus providing electrical connection to the second heater. The intermediate portion 288 overlaps the second heater 264 and the first heater 262. The input trace 262 overlaps the first heater at an end opposite to an end overlapped by the intermediate portion. In other embodiments, the heaters may be a single layer of heater material formed beneath the input and output traces such that the heater material is formed first and then covered by a conductive material for the input and output traces. Then an etching step is preformed to define the input and output traces such that the heater material underneath is the same shape as the input and the output traces. The removal of the input and output traces may be performed in stages to allow for leaving some of the heater material exposed, such as the heaters shown in FIG. 5B.

In FIG. 5B, a dielectric material 290 is formed over the first and second heaters and over the input trace, the output trace, and the intermediate portion. The chamber 266 is bounded by a non-conductive chamber layer 292. The columns 272 may be formed of the same material as the chamber layer 292. The chamber 266 has dimensions that are slightly larger than the outer edges of the first and second heaters. The second heater acts as a limiter to fluid flow out of the chamber when a primary bubble bursts. This increases the firing frequency of the chamber.

The first and second heaters are formed as resistors. In one embodiment, the first and second heaters are a 20-nanometer thick tantalum aluminum layer. In another embodiment, the heater may include chromium silicon films, each having different percentages of chromium and silicon and each being 10 nanometers thick. Other materials for the heaters may include tantalum silicon nitride and tungsten silicon nitride. The heaters may also include a 30-nanometer cap of silicon nitride. In an alternative embodiment, the heaters may be formed by depositing multiple thin film layers in succession. A stack of thin film layers combine the elementary properties of the individual layers. In a preferred embodiment, the heater may be 1000 Angstroms thick. A 2000 Angstrom layer of tantalum may be over each heater and a 3000 Angstrom layer of dielectric may be over the tantalum. A tantalum protective layer may be included on each heater as a cavitation defense.

In this embodiment, both heaters have a same length 274, but have different widths. The length 274 is greater than a dimension 276 of the neck portion 270. The length of the second heater 264 is configured to prevent or minimize an amount of blowback from the formation and explosion of bubbles formed by the first heater 262. The length is greater than the dimension 276 of the neck portion to create a blockage for the fluid in the chamber that is not expelled by through the nozzle.

FIG. 6 is a schematic isometric view of a microfluidic delivery system 10 in accordance with one embodiment of the present disclosure. The microfluidic delivery system 10 formed in accordance with one embodiment of the disclosure that may include the microfluidic die described above. The microfluidic delivery system 10 includes a housing 12 having an upper surface 14, a lower surface 16, and a body portion 18 between the upper and lower surfaces. The upper surface of the housing 12 includes a first hole 20 that places an environment external to the housing 12 in fluid communication with an interior portion 22 of the housing 12. The interior portion 22 of the housing 12 includes a holder 24 that holds a removable microfluidic refill cartridge 26. The microfluidic delivery system 10 is configured to use thermal energy to deliver fluid from within the microfluidic refill cartridge 26 to the environment external to the housing 12, such as vertically through the first hole 20.

Access to the interior portion 22 of the housing is provided by an opening 28 in the body portion 18. The opening 28 is accessible by a cover or door 30 of the housing 12.

The holder 24 includes an upper surface 32 and a lower surface 34 that are coupled together by one or more sidewalls 36 and has an open side 38 through which the microfluidic refill cartridge 26 can slide in and out. The upper surface 32 of the holder 24 includes an opening 40 that is aligned with the first hole 20 of the housing 12.

The housing 12 may include external electrical connection elements for coupling with an external power source. The external electrical connection elements may be a plug configured to be plugged into an electrical outlet or battery terminals. Internal electrical connections couple the external electrical connection elements to the holder 24 to provide power to the microfluidic refill cartridge. The housing 12 may include a power switch 42 on a front of the housing 12.

Figure 7:
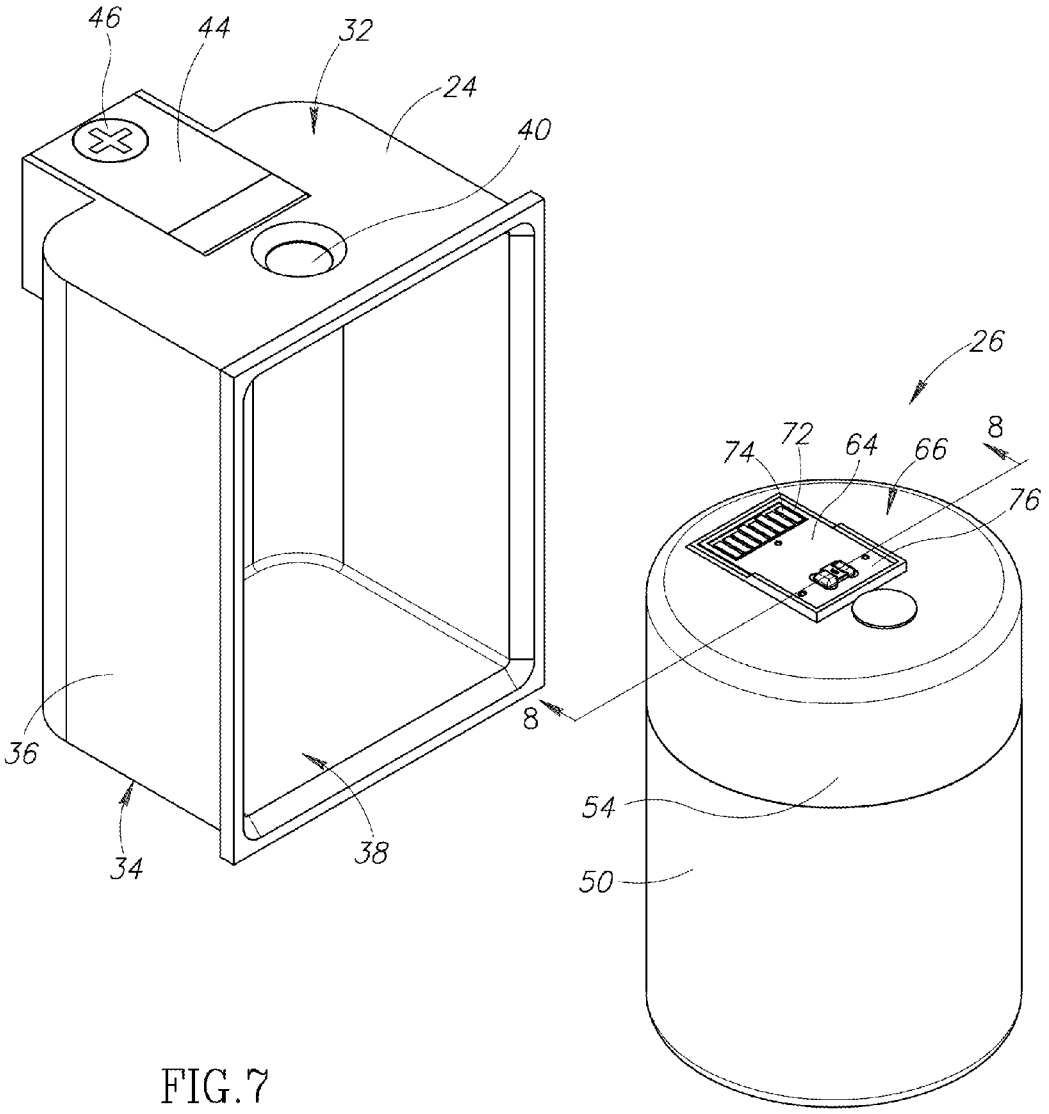
FIG. 7 is a schematic isometric view of a microfluidic refill cartridge and a holder of the microfluidic delivery system of FIG. 6.

FIG. 7 is a schematic isometric view of a microfluidic refill cartridge 26 and a holder 24 of the microfluidic delivery system of FIG. 6. In this figure, the microfluidic refill cartridge 26 is removed from the holder 24. A circuit board 44 is coupled to the upper surface 32 of the holder by a screw 46. The circuit board 44 includes electrical contacts 48 that electrically couple to the microfluidic refill cartridge 26. The electrical contacts 48 of the circuit board 44 are in electrical communication with the internal and external electrical connection elements.

Figure 8:
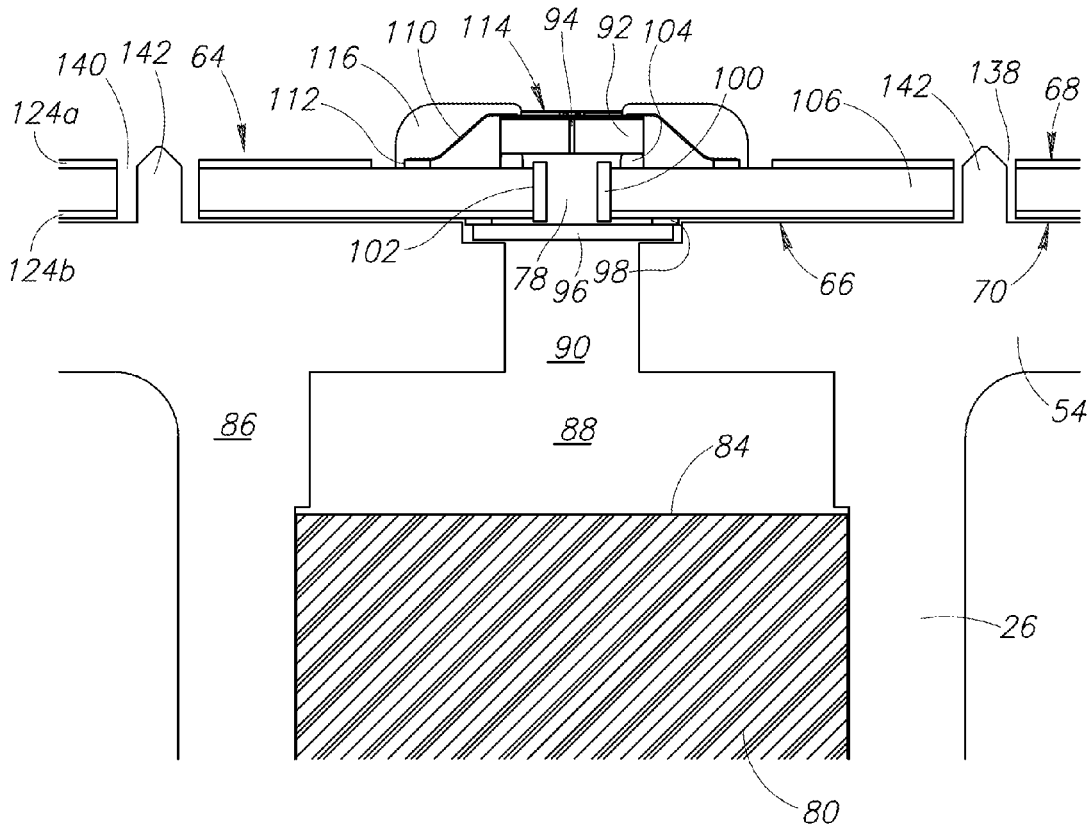
FIG. 8 is a cross-section schematic view of line 8-8 in FIG. 7.

The microfluidic refill cartridge 26 includes a reservoir 50 for holding a fluid 52, see FIG. 8. The reservoir 50 may be any shape, size, or material configured to hold any number of different types of fluid. The fluid held in the reservoir may be any liquid composition. In one embodiment, the fluid is an oil, such as a scented oil. In another embodiment, the fluid is water. It may also be alcohol, a perfume, a biological material, a polymer for 3-D printing, or other fluid. A lid 54 may be secured to the reservoir in a variety of ways known in the art.

A microfluidic delivery member 64 is secured to an upper surface 66 of the lid 54 of the microfluidic refill cartridge 26. The microfluidic delivery member 64 includes an upper surface 68 and a lower surface 70 (see FIGS. 9A-9C). A first end 72 of the upper surface 68 includes electrical contacts 74 for coupling with the electrical contacts 48 of the circuit board 44 when placed in the holder 24. A second end 76 of the microfluidic delivery member 64 includes a part of a fluid path that passes through an opening 78 for delivering fluid.

FIG. 8 is a cross-section view of the microfluidic refill cartridge 26 in the holder 24 along the line 8-8 shown in FIG. 7. Inside the reservoir 50 is a fluid transport member 80 that brings fluid from the reservoir 50 to an end 84 that is located below the microfluidic delivery member 64. In some embodiments, the fluid transport member 80 includes one or more porous materials that allow the fluid to flow from the reservoir to the end 84 by capillary action. The construction of the member 80 permits fluid to travel through the fluid transport member 80 against gravity. Fluid can travel by wicking, diffusion, suction, siphon, vacuum, or other mechanism. The fluid transport member 80 may be in the form of fibers or sintered beads.

The end 84 of the fluid transport member 80 is surrounded by a transport cover 86 that extends from the inner surface of the lid 54. The end 84 of the fluid transport member 80 and the transport cover 86 forms a chamber 88. The chamber 88 may be substantially sealed between the transport cover 86 and the fluid transport member 80 to prevent air from the reservoir 50 from entering the chamber 88.

Above the chamber 88 is a first through hole 90 in the lid 54 that fluidly couples the chamber 88 above the end 84 of the fluid transport member 80 to the fluid path through the opening 78 of the microfluidic delivery member 64. The microfluidic delivery member 64 is secured to the lid 54 above the first through hole 90 of the lid, and receives fluid.

Figure 9A:
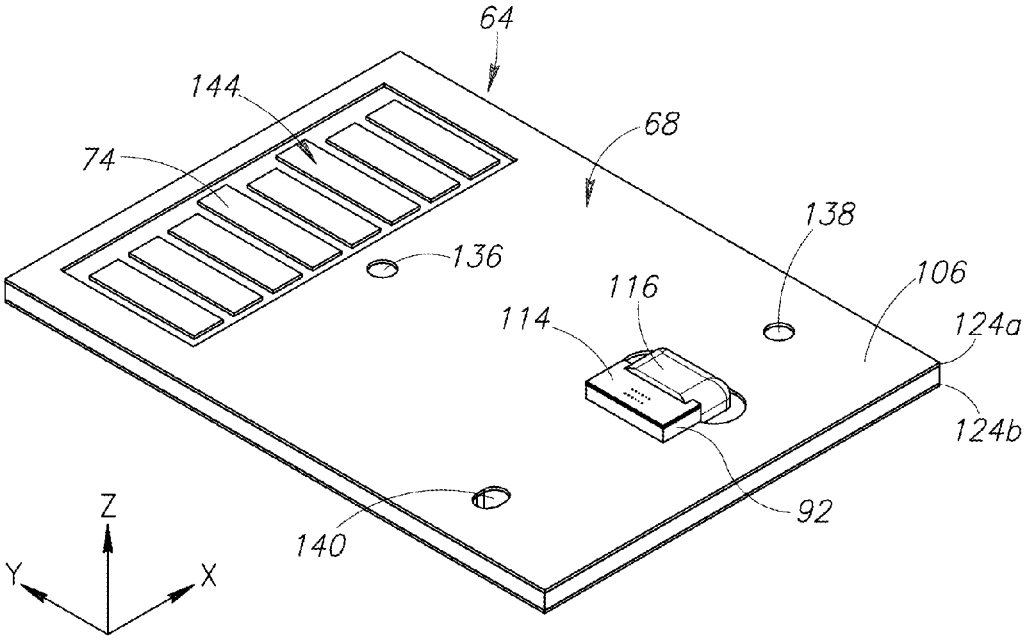
FIGS. 9A-9B are schematic isometric views of a microfluidic delivery member in accordance with an embodiment of the present disclosure.
Figure 9B:
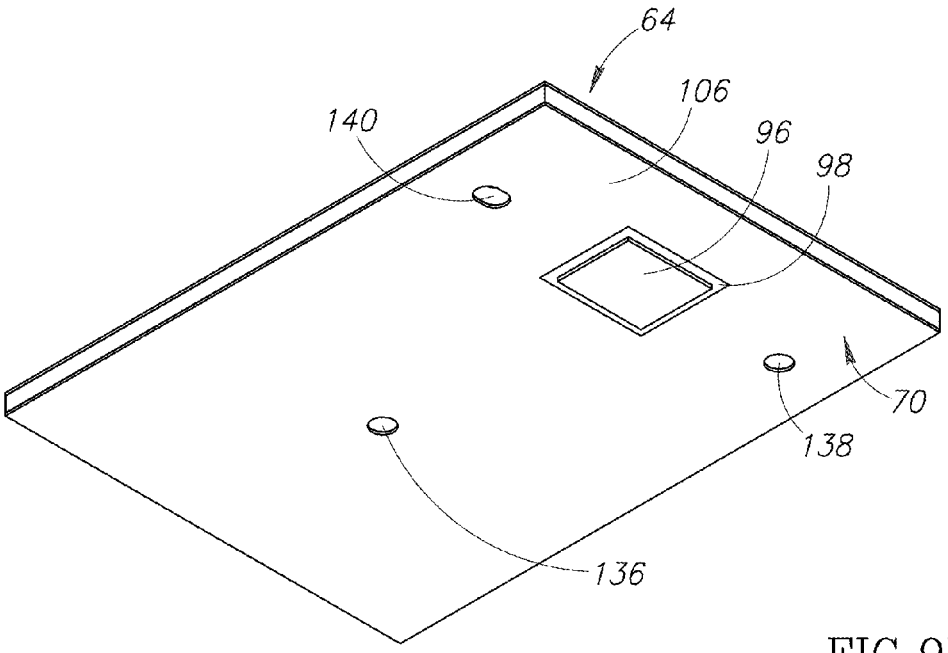
Figure 9C:
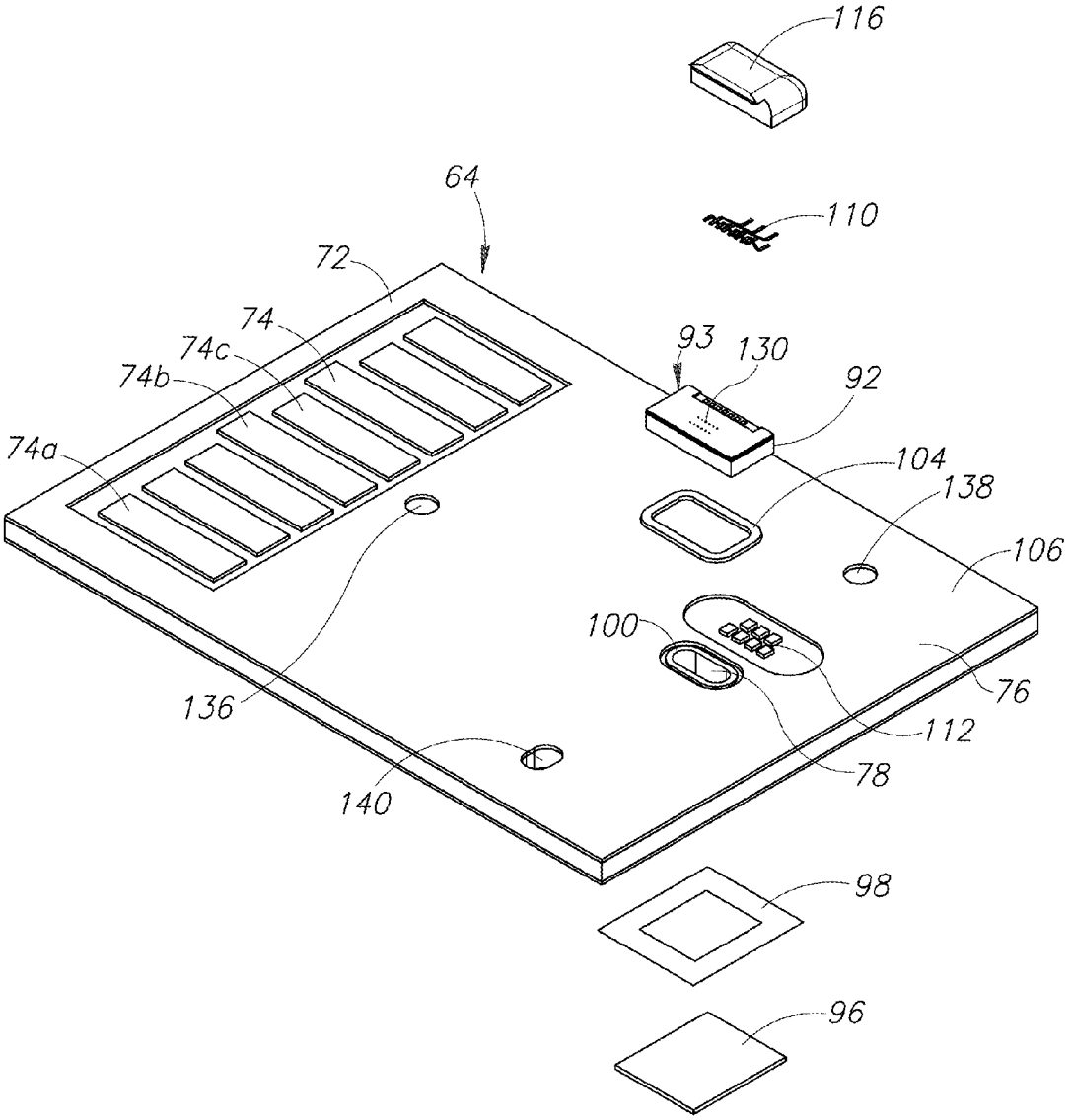
FIG. 9C is an exploded view the microfluidic delivery member of FIG. 9A.

FIGS. 9A-9B are schematic isometric views of a microfluidic delivery member in accordance with an embodiment of the present disclosure and FIG. 9C is an exploded view the microfluidic delivery member of FIG. 9A. The microfluidic delivery member 64 may include a printed circuit board 106 that carries a semiconductor die 92. The printed circuit board 106 includes first and second circular openings 136, 138 and an oval opening 140. Prongs from the lid 54 extend through the openings 136, 138, 140 to ensure the board 106 is aligned with the fluid path appropriately. The oval opening 140 interacts with a wider prong so that the board 106 can only fit onto the lid 54 in one arrangement.

The upper and lower surfaces of the board may be coated with a solder mask 124*a*, 124*b* (collectively 124). Openings in the solder mask 124 may be provided where contact pads 112 of the die 92 are positioned on the circuit board 106 or at the first end 72 where the contacts 74 are formed. The solder mask 124 may be used as a protective layer to cover electrical connections (not shown) carried by the board 106 that couple the contact pads 112 of the die 92 to the electrical contacts 74, which couple the contact pads 112 to the external power source.

The printed circuit board 106 (PCB) is a rigid planar circuit board, having the upper and lower surfaces 68, 70. The circuit board 106 includes one or more layers of insulative and conductive materials. In one embodiment, the substrate 107 includes a FR4 PCB 106, a composite material composed of woven fiberglass with an epoxy resin binder that is flame resistant. In other embodiments, the substrate 107 includes ceramic, glass or plastic.

The circuit board 106 includes all electrical connections on the upper surface 68 of the board 106. For example, a top surface 144 of the electrical contacts 74 that couple to the housing are parallel to an x-y plane. The upper surface 68 of the board 106 is also parallel to the x-y plane. In addition, a top surface 146 of a nozzle plate 132 of the die 92 is also parallel to the x-y plane. The contact pads 112 also have a top surface that is parallel to the x-y plane. By forming each of these features to be in parallel planes, the complexity of the board 106 is reduced and is easier to manufacture. In addition, this allows nozzles 130 to eject the fluid vertically (directly up or at an angle) away from the housing, such as could be used for spraying scented oils into a room as air freshener. This arrangement could create a scented plume 5-10 cm high.

The board 106 includes the electrical contacts at the first end and contact pads 112 at the end proximate the die 92. Electrical traces from the contact pads 112 to the electrical contacts are formed on the board and may be covered by the solder mask or another dielectric.

On the lower surface of the board, the filter 96 may be provided to separate the opening 78 of the board 106 from the chamber 88 at the lower surface of the PCB. The filter 96 is configured to prevent at least some of the particles from passing through the opening to prevent clogging of the nozzles 130 of the die 92. In some embodiments, the filter 96 is configured to block particles that are greater than one third of the diameter of the nozzles 130. It is to be appreciated that in some embodiments, the fluid transport member 80 can act as a suitable filter 96, so that a separate filter 96 is not needed. The filter 96 is attached to the bottom surface with adhesive material 98. The adhesive material 98 may be an adhesive material that does not readily dissolve by the fluid in the reservoir 50.

The opening 78 may be formed as an oval, as is illustrated in 9C; however, other shapes are contemplated depending on the application. The opening 78 exposes sidewalls 102 of the board 106. If the board 106 is an FR4 PCB, the bundles of fibers would be exposed by the opening. These sidewalls are susceptible to fluid and thus a liner 100 is included to cover and protect these sidewalls. If fluid enters the sidewalls, the board could begin to deteriorate, cutting short the life span of this product.

The liner 100 is configured to protect the board from all fluids that an end user may select to eject through the die 92. For example, if the die 92 is used to eject scented oils from the housing, the liner 100 is configured to protect the sidewalls of the board 106 from any damage that could be caused by the scented oils. The liner 100 prolongs the life of the board 106 so that an end user can reuse the housing and the die 92 again and again with refillable or replaceable fluid cartridges.

Other fluids that could be expelled by this system have different chemical properties than typical ink used with inkjet printers. Prior inkjet print heads used very expensive, very specific materials to prevent the ink from damaging the components that support the ink ejection process, such as the reservoir 50. In the present disclosure, common materials, such as an FR4 board, can be utilized to create a sophisticated, but cost effective system. The liner 100 provides a protective coating to allow the cost effective FR4 board to be utilized in this system. In one embodiment, the liner is gold, however, in other embodiments the liner may be silicon nitride, other oxides, silicon carbide, and other metals, such as tantalum or aluminum, or a plastic, such as PET.

A second mechanical spacer 104 separates a bottom surface 108 of the die 92 from the upper surface 68 of the printed circuit board 106. An encapsulant 116 covers the contact pads 112 and leads 110, while leaving a central portion 114 of the die exposed. In this embodiment, the contact pads 112 are only on one side of the die 92. In other embodiments, there may be contacts extending from both sides of the die. Alternatively, the contacts may extend from a smaller edge of the die that is closer to the electrical contacts 74. A smaller amount of the encapsulant 116 will help reduce potential issues with the encapsulant covering or interfering with one of the nozzles. Thus, it is advantageous to include all of the contacts one side of the die.

Figure 10A:
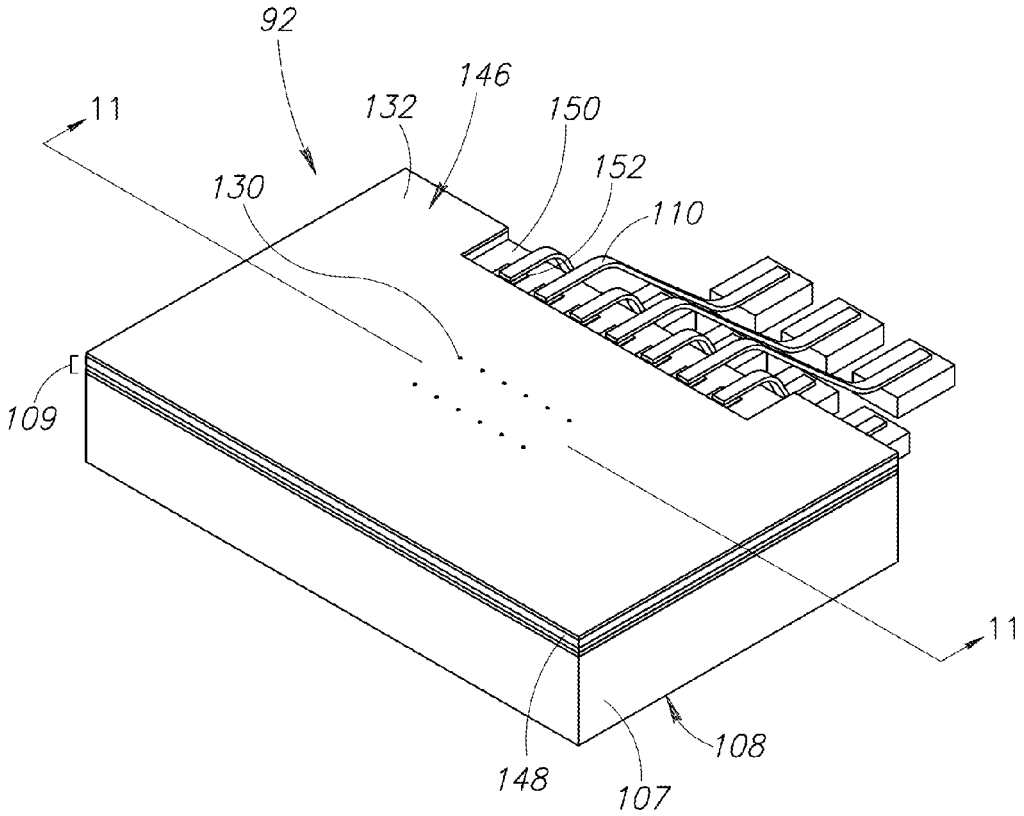
FIGS. 10A-10C are schematic isometric views of the microfluidic die of FIG. 9A at various layers in accordance with the present disclosure.
Figure 10B:
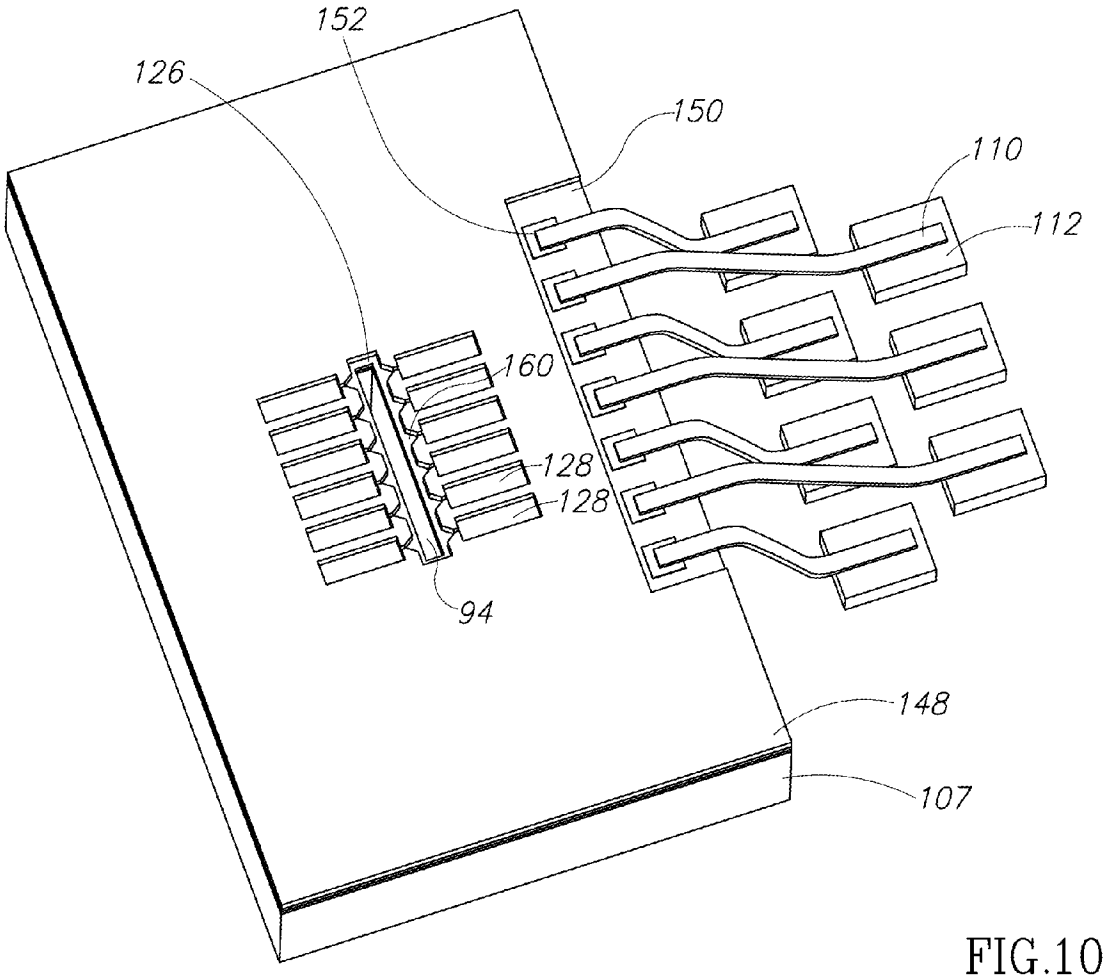
Figure 10C:
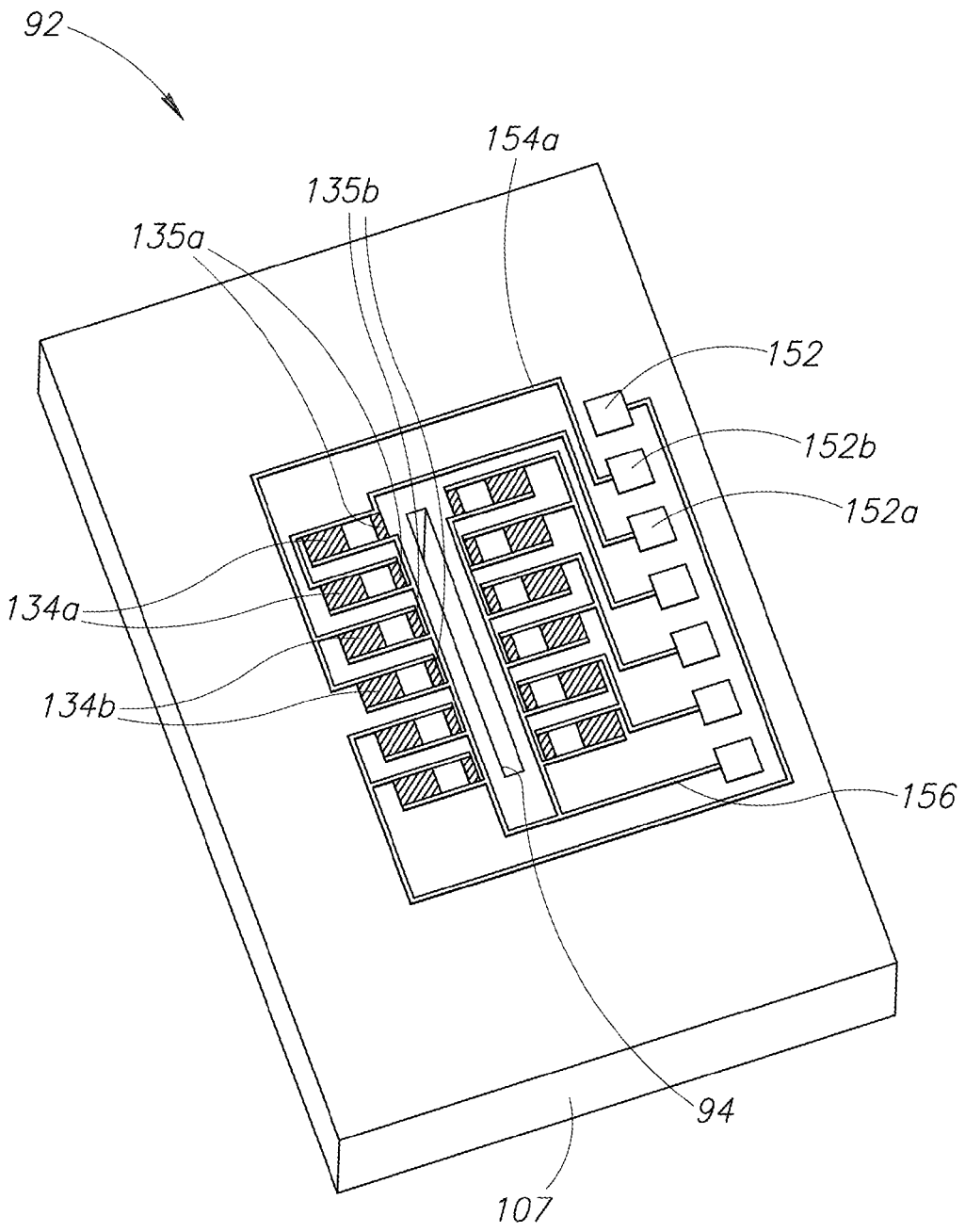

FIGS. 10A-10C are schematic isometric views of the microfluidic die 92 at various layers in accordance with the present disclosure. The microfluidic die 92 includes a substrate 107, a plurality of intermediate layers 109, and a nozzle plate 132. The plurality of intermediate layers 109 include dielectric layers and a chamber layer 148 that are positioned between the substrate and the nozzle plate. In one embodiment, the nozzle plate is 10-12 microns thick.

The die 92 includes a plurality of electrical connection leads 110 that extend from one of the intermediate dielectric layers 109 down to the contact pads 112 on the circuit board 106. Each lead 110 couples to a single contact pad. An opening 150 on the right side of the die provides access to the intermediate layers 109 to which the leads are coupled. The opening 150 passes through the nozzle plate 132 and chamber layer 148 to expose contact pads 152 that are formed on the intermediate dielectric layers. In other embodiments, there may be two openings 150 positioned on both sides of the die such that the leads extend from the die extend from both sides.

In the illustrated embodiment, there are twelve nozzles 130 through the nozzle plate 132—six nozzles on each side of a center line. FIG. 10B is a top down isometric view of the die 92 with the nozzle plate 132 removed such that the chamber layer 148 is exposed. Each nozzle is in fluid communication with the fluid in the reservoir 50 by a fluid path that includes the fluid transport member 80, through the transport member 80 to the end 84, the chamber 88 above the end 84 of the transport member, the first through hole 90 of the lid 54, the opening 78 of the PCB, through an inlet 94 of the die 92, then through a channel 126, and to the chamber 128, and out of the nozzle 130 of the die.

The die 92 includes an inlet path 94 that passes completely through the substrate 107 and interacts with the chamber layer 148 and the nozzle plate 132. The inlet path 94 is a rectangular opening; however, other shapes may be utilized according to the flow path constraints. The inlet path 94 is in fluid communication with the fluid path that passes through the opening 78 of the board 106.

The inlet path 94 is coupled to a channel 126 (see FIGS. 11A-11B) that is in fluid communication with individual chambers 128, forming the fluid path. Above the chambers 128 is the nozzle plate 132 that includes the plurality of nozzles 130. Each nozzle 130 is above a respective one of the chambers 128. The die 92 may have any number of chambers and nozzles, including one chamber and nozzle. In the illustrated embodiment, the die includes twelve chambers, each associated with a respective nozzle. Alternatively, it can have two chambers providing fluid for a group of six nozzles. It is not necessary to have a one-to-one correspondence between the chambers and nozzles.

Proximate each nozzle and chamber is a first heater 134 and a second heater 135 (see FIG. 10C) that are electrically coupled to and activated by electrical signals provided by ones of the contact pads 152 of the die 92. In this embodiment, the first heater 134 and the second heater 135 of each chamber are driven together, in that they have the same power and ground. In addition, in this embodiment, pairs of chambers have the first heater 134 and the second heater 135 driven together. For example, there are 6 pairs of chambers with heaters driven together. A first pair of chambers is driven by a first electrical trace 154*a*, which is coupled to a first one 152*a* of the contacts 152. The first input electrical trace is coupled to both of the first heaters 134*a* and both of the second heaters 135*a*. Each of the first heaters 134*a* and each of the second heaters 135*a* are coupled to an output electrical trace 156, which is coupled to ground. In this embodiment, there is only a single ground line that is shared by all of the heaters. Although FIG. 10C is illustrated as though all of the features are on a single layer, they may be formed on several stacked layers of dielectric and conductive material.

A second pair of chambers is driven by a second input electrical trace 154*b* that is coupled to two of the first heaters 134*b* and two of the second heaters 135*b*. The second input electrical trace 154*b* is coupled to another one 152*b* of the electrical contacts 152. There are seven electrical contacts 152, one of which is coupled to the ground (the output electrical trace 156) and six of which are coupled to pairs of the chambers (coupled to four heaters, two first heaters and two second heaters).

It is preferable to have a resistance of each heater be significantly larger than a parasitic resistance of the first and second contacts. For example, the heaters may have a resistance of 60 ohms and the parasitic resistance of the contacts will be 10 ohms. To achieve this, the contacts may be made wider. The traces, pads, and contacts can be made wider to reduce the resistance.

In use, when the fluid in each of the chambers 128 is heated by the first heater 134, the fluid vaporizes to create a bubble. The expansion that creates the bubble causes fluid to eject from the nozzle 130 and to form a drop or droplet.

Figure 11A:
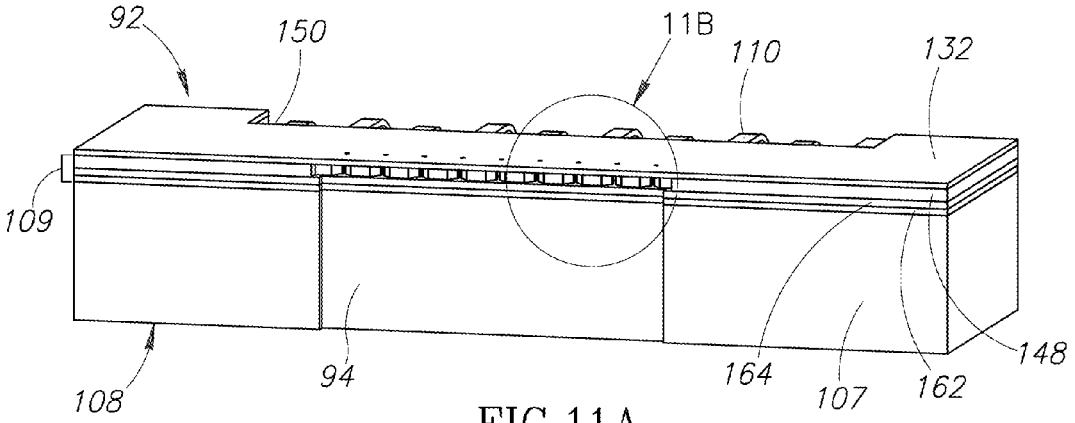
FIG. 11A is a cross-section view of line 11-11 in FIG. 10A.
Figure 11B:
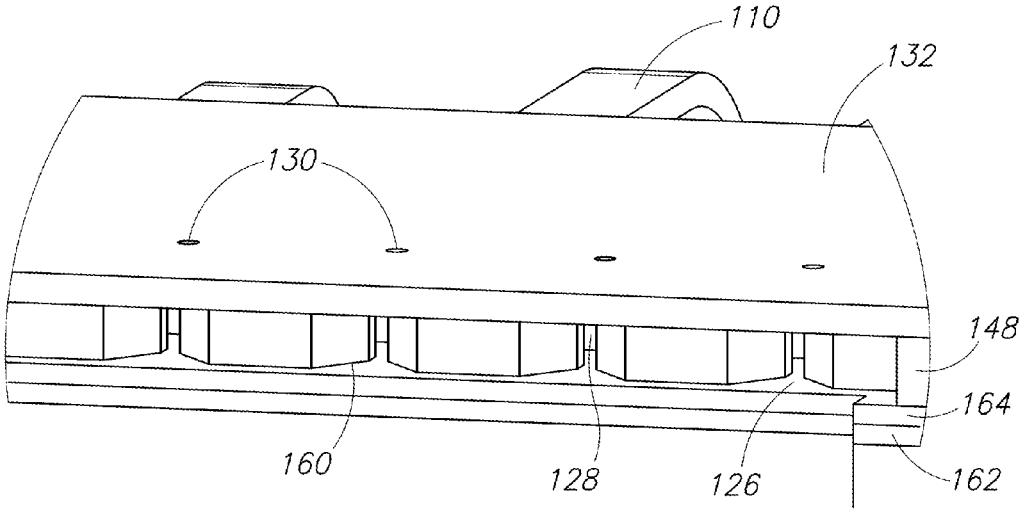
FIG. 11B is an enlarged view of a portion of FIG. 11A.

FIG. 11A is a cross-section view of line 11-11 in FIG. 10A and FIG. 11B is an enlarged view of a portion of FIG. 11A. As mentioned above, the substrate 107 includes the inlet path 94 through a center region associated with the chambers 128 and the nozzles 130. The inlet path is configured to allow fluid to flow up from the bottom surface 108 of the die into the channels which couple to the nozzle chambers and heat the fluid to be ejected out of the nozzles.

The chamber layer 148 defines angled funnel paths 160 that feed the fluid from the channel 126 into the chamber 128. The funnel paths 160 act as a mechanical limiter to fluid flow away from the chamber. The chamber layer 148 is positioned on top of the intermediate dielectric layers 109. The chamber layer defines the boundaries of the channels and the plurality of chambers associated with each nozzle. In one embodiment, the chamber layer is formed separately in a mold and then attached to the substrate. In other embodiments, the chamber layer is formed by depositing, masking, and etching layers on top of the substrate.

The intermediate layers 109 include a first dielectric layer 162 and a second dielectric layer 164. The first and second dielectric layers are between the nozzle plate and the substrate. The first dielectric layer 162 covers the plurality of first and second electrical traces 154, 156 formed on the substrate, and covers the heaters 134, 135 associated with each chamber. The first and second electrical traces may be formed on two conductive levels. For example, a first conductive level may be formed on top of the heater material used to form the first and second heaters, such that a first conductive layer overlaps portions of the heater material. The conductive layer is etched to form first and second contacts. Then the first dielectric layer would cover the heaters and the first and second contacts. Then a second conductive layer is formed on the first dielectric layer. Vias can couple the second conductive layer to the first and second contacts through the first dielectric layer. The first and second electrical traces 154, 156 may be formed from the second conductive layer. The second conducive layer would be covered by the second dielectric layer 164.

Figure 12:
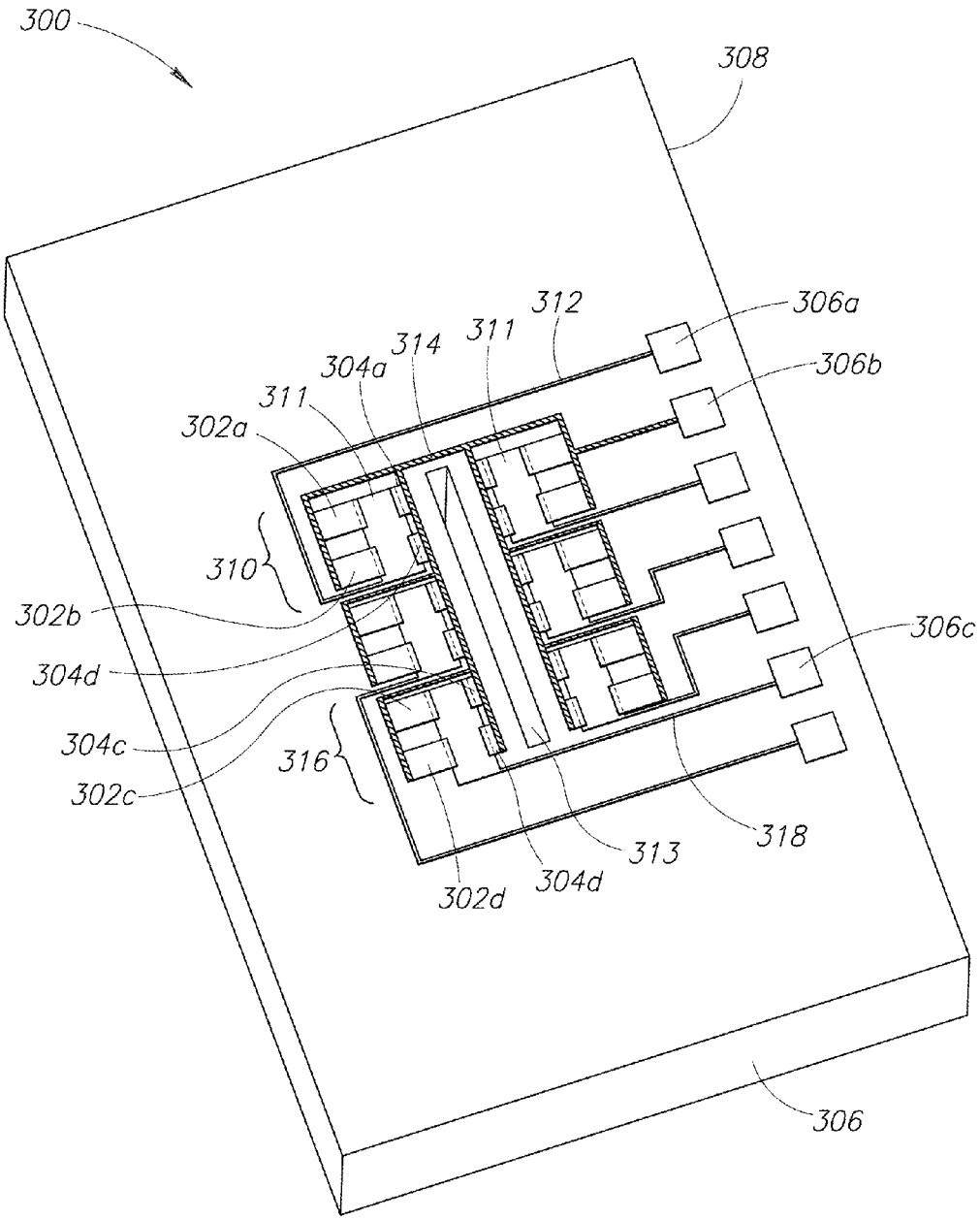
FIG. 12 is a top down isometric view of a portion of a die with multiple heaters according to embodiments of the present disclosure.

FIG. 12 is a top down isometric view of a portion of a microfluidic die 300 having with multiple heaters 302, 304 per nozzle and chamber according to embodiments of the present disclosure. The die 300 includes a semiconductor substrate 306 onto which a chamber layer and a nozzle plate will be applied in subsequent processing steps. Each chamber is will be formed over a pair of heaters, each pair including a first larger heater 302 and a second smaller heater 304. In some embodiments, the nozzle is positioned between the first heater 302 and the second heater 304. In other embodiments, the nozzle will be positioned directly above the first heater 302.

As with previously described embodiments, the die 300 includes a plurality of contact pads 306 formed along one side 308 of the die. In this embodiment, there are seven contact pads 306. There may be a larger number or a smaller number of contact pads based on a number of chambers and a method of driving each pair of heaters. Groups of the pairs of heaters 302, 304 are driven together in this die. A first group 310 of four heaters 302*a*, 304*a*, 302*b*, 304*b* is driven by a single contact pad, 306*a*. The contact pad 306*a* is coupled to a first electrical trace 312. The first electrical trace 312 overlaps each of the four heaters 302*a*, 304*a*, 302*b*, 304*b* in a central region 311 between each pair of heaters.

The first electrical trace 312 may be formed before the heaters 302*a*, 304*a*, 302*b*, 304*b* are formed or alternatively, may be formed after the heaters 302*a*, and 304*a*, 302*b*, and 304*b* are formed. In this Figure, the dashed lines of the first electrical trace 312 indicate that the heaters 302*a*, 304*a*, 302*b*, 304*b* are formed after the first electrical trace 312 is formed.

Each of the four heaters 302*a*, 304*a*, 302*b*, and 304*b* is also coupled to an output or ground electrical trace 314, which is coupled to a contact 306*b*. A second group 316 of pairs of heaters 302*c*, 304*c*, 302*d*, 304*d* is also driven together by a second electrical trace 318, which is coupled to a single contact 306*c*. There are a total of six groups of pairs of heaters 302, 304 that are formed on this die 300. Each heater is coupled to the ground trace 314. The ground trace 314 is positioned between each of the second heaters 304 and an inlet port 313 through the substrate.

Figure 13:
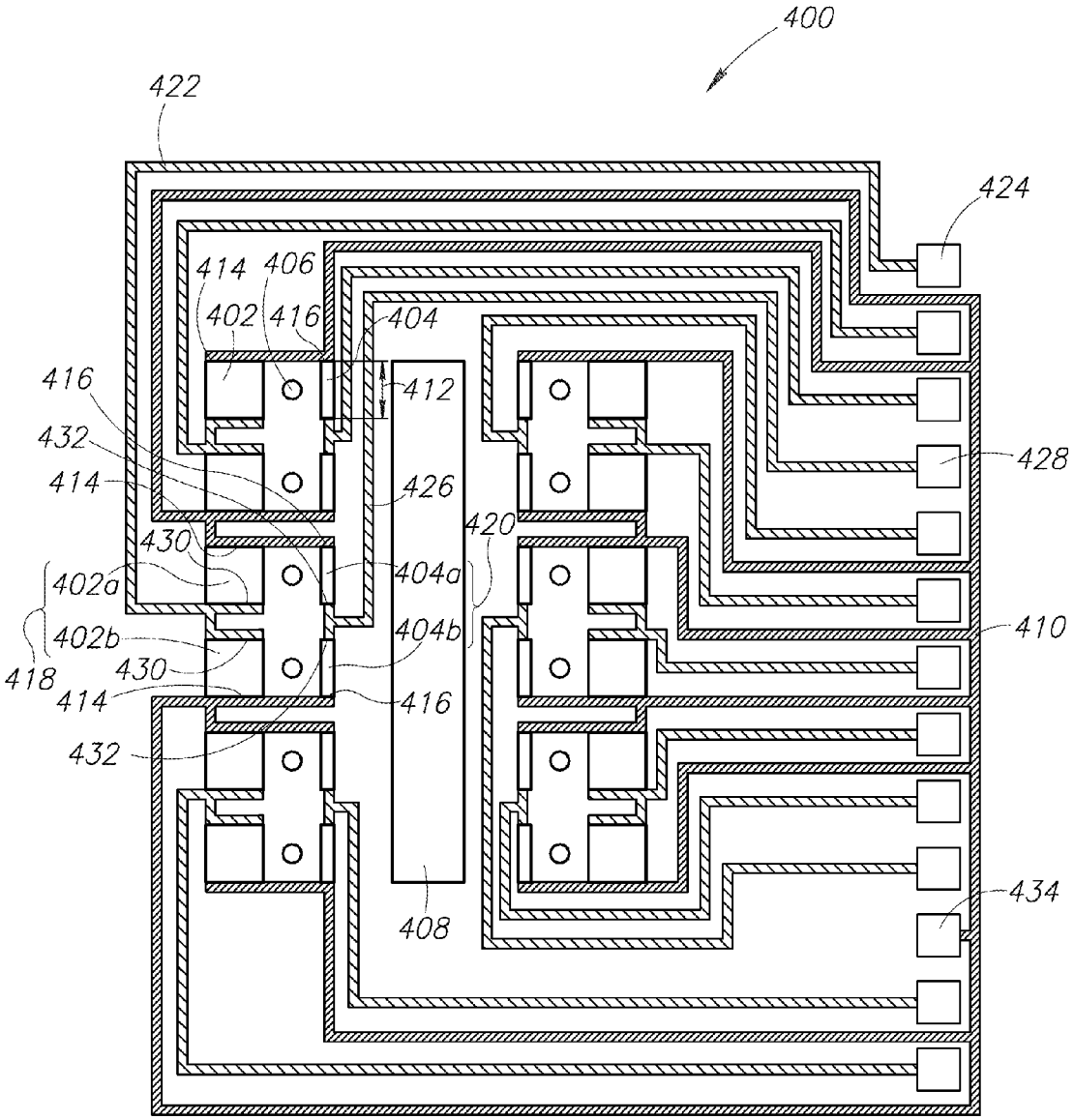
FIG. 13 is a top down view of alternative embodiments of heaters and nozzle arrangements according to the present disclosure.

FIG. 13 is a top down view of an alternative embodiment of heaters 402, 404 and nozzle 406 arrangements on a microfluidic die 400 according to the present disclosure. This is a simplified view showing various components of this die 400 from a top down view. For example, boundaries of chambers are not provided to avoid unnecessarily complicating this figure. In some embodiments, each nozzle 406 is associated with a single chamber. In alternative embodiments, a single chamber may correspond to a pair of nozzles, which would then correspond to two pairs of heaters 402, 404.

This microfluidic die 400 includes an inlet path 408 that allows any number of fluids to flow from a reservoir through the inlet path 408 into the chambers (not shown). The inlet path 408 is provided to indicate arrangement of the various components with respect to the inlet path. Each smaller rectangular heater 404 is positioned closer to the inlet path than each larger square heater 402. As mentioned above, the smaller heater 404 is included to prevent or reduce an amount of blowback of fluid that occurs when a bubble formed by the larger heater 402 explodes to eject the fluid. The smaller heater 404 is configured to create a smaller bubble to impede the fluid flowing away from the larger heater after the bubble explodes. Often the smaller heater 404 has a dimension 412 that is larger than a width of a fluid flow path that feeds the fluid from the inlet path to the chamber, for example, as shown in FIGS. 3 and 4.

There is a single ground line 410 coupled to every heater 402, 404. In this embodiment, pairs of the larger heaters 402 are driven separately from pairs of the smaller heaters 404. A first pair 418 of the larger heaters 402*a*, 402*b* is driven by a first electrical trace 422, which is coupled to a first contact pad 424. A second pair 420 of the smaller heaters 404*a*, 404*b* is driven by a second electrical trace 426, which is coupled to a second contact pad 428. The first electrical trace 422 is coupled to an interior edge 430 of each larger heater 402, the interior edges facing each other in the pair 418. The ground line 410 is coupled to an opposite edge 414 to the interior edge 430 of each of the larger heaters 402.

The second pair of smaller heaters 404*a*, 404*b*, is each coupled to the second electrical trace 426 on interior edges 432 that face each other. The ground line 410 is coupled to each of the smaller heaters 404*a*, 404*b* at an exterior edge 416 that is opposite to the interior edges 432.

The ground line 410 is coupled to a contact 434. Because the larger heaters are driven separately from the smaller heaters more contacts are needed than some of the previously described embodiments. In this embodiment, there are 13 contacts, one of which is the ground contact 434. In order to have all traces formed on a single conductive level of the die, the ground traces extend past each contact and travel along an outer edge of the contacts to the ground contact 434. There are six contacts that drive pairs of larger heaters and there are six contacts that drive pairs of the smaller heaters.

The larger heaters are driven independently of the smaller heaters allowing the blowback prevention to be tuned by the manufacturer or user based on the type of fluid or speed of ejection selected. As noted above, there are various configurations of how to drive the different heaters. For example, both heaters of a single chamber may be driven together. Alternatively, each heater of a single chamber may be driven separately. In addition, a chamber may include several large heaters and several small heaters such that there is a nozzle for each pair of small and large heaters.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:
a substrate;
a first heater on the substrate;
a second heater spaced from the first heater on the substrate, the first heater being larger in area than the second heater;
a first microfluidic chamber aligned with the first heater and the second heater;
a first nozzle aligned with the first chamber; and
a channel region in fluid communication with the first microfluidic chamber and the first nozzle, the first heater being separated from the channel region by the second heater, the first nozzle being separated from the channel region by the second heater.

2. The device of claim 1, further comprising:
an inlet path through the substrate,
the inlet path being in fluid communication with the channel region, the first microfluidic chamber, and the first nozzle.

3. The device of claim 2, further comprising:
a third heater formed on the substrate;
a fourth heater formed on the substrate;
a second microfluidic chamber aligned with the third heater and the fourth heater; and
a second nozzle aligned with the second chamber, the second nozzle being in fluid communication with the inlet path, the channel region, and the second chamber.

4. The device of claim 3 wherein the third heater has a larger area than the fourth heater.

5. The device of claim 3, further comprising:
a first contact pad;
a second contact pad;
a third contact pad;
a first electrical trace coupled between the first heater and the first contact pad;
a second electrical trace coupled between the second heater and the second contact pad; and
a third electrical trace coupled between the third heater and the third contact pad.

6. The device of claim 5 wherein the fourth heater is coupled to the second electrical trace.

7. The device of claim 1, further comprising:
a first contact pad;
a second contact pad;
a first electrical trace coupled between the first heater and the first contact pad; and
a second electrical trace coupled between the second heater and the second contact pad.

8. The device of claim 7, further comprising a third electrical trace between the first heater and the second heater.

9. The device of claim 7 wherein the first electrical trace is coupled to a first side of the first heater and a first side of the second heater and the second electrical trace is coupled to a second side of the first heater and a second side of the second heater.

10. The device of claim 1 wherein the first nozzle is positioned between the first heater and the second heater.

11. The device of claim 1 wherein the first nozzle includes a first axis passing through a center of the first nozzle and the first axis passes through a center point of the first heater.

12. A device, comprising:
a substrate;
a plurality of first heaters on the substrate;
a plurality of second heaters on the substrate, each second heater having a smaller area than each first heater, each second heater having an outer edge;

a plurality of chambers, each chamber having an area that encompasses one of the first heaters and one of the second heaters;

a plurality of nozzles, each chamber being associated with one of the nozzles, each nozzle having an outer diameter, the outer diameter of each nozzle being non-overlapping with the outer edge of each second heater; and an inlet path in fluid communication with each of the plurality of chambers, each second heater being closer to the inlet path than each first heater.

13. The device of claim 12 wherein each nozzle is positioned between one of the first heaters and one of the second heaters.

14. The device of claim 12 wherein an axis through each nozzle is aligned with a center point of each of the first heaters.

15. A method, comprising:

forming a first heater on a substrate with a first area;

forming a second heater with a second area spaced from the first heater on the substrate, the first area being larger than the second area;

forming a first microfluidic chamber, the first chamber covering the first heater and the second heater;

forming a first nozzle aligned with the first chamber;

forming an inlet path through the substrate, the inlet path being in fluid communication with the first nozzle and the first microfluidic chamber, the first nozzle being separated from the inlet path by the second heater.

16. The method of claim 15, further comprising:

forming a third heater on the substrate adjacent to the first heater;

forming a fourth heater spaced from the third heater on the substrate, the third heater being larger than the fourth heater;

forming a second microfluidic chamber, the second chamber covering the third heater and the fourth heater; and forming a second nozzle aligned with the second chamber.

17. The method of claim 16, further comprising:

forming a channel in fluid communication with the inlet path, the first chamber, and the second chamber, the channel including a neck portion that has a first width, the each of the first chamber and the second chamber having a same second width, the first width being smaller than the second width.

* * * * *